United States Patent [19]

de la Sota Martinez

[11] Patent Number: 4,580,834

[45] Date of Patent: Apr. 8, 1986

[54] CHAIR CONVERTIBLE TO EASY CHAIR

[76] Inventor: Alejandro de la Sota Martinez, Avenida de América No. 49, Madrid-16, Spain

[21] Appl. No.: 389,154

[22] Filed: Jun. 16, 1982

[30] Foreign Application Priority Data

Jun. 23, 1981 [ES] Spain ..... 259.096

[51] Int. Cl.[4] ..... A47C 4/00; A47C 13/00

[52] U.S. Cl. ..... 297/130; 16/374; 16/387; 297/3; 297/92; 297/443; 403/386; 403/400

[58] Field of Search ..... 297/1, 3, 92, 94, 130–132, 297/325, 443; 16/374, 382, 387; 403/385, 386, 400

[56] References Cited

U.S. PATENT DOCUMENTS 59,403 11/1866 Jouett ..... 297/1

FOREIGN PATENT DOCUMENTS

| | | | |
|---|---|---|---|
| 173291 | 5/1952 | Austria | 297/443 |
| 75773 | 7/1961 | France | 403/400 |
| 604745 | 5/1960 | Italy | 297/443 |
| 235320 | 6/1925 | United Kingdom | 403/385 |

*Primary Examiner*—William E. Lyddane
*Assistant Examiner*—Peter R. Brown
*Attorney, Agent, or Firm*—Wenderoth, Lind & Ponack

[57] ABSTRACT

A chair, convertible to a recliner, includes a first frame part, a pivot arranged in a middle section of the first frame part, a second frame part having a shape and lines similar to the first frame part, a sliding joint arranged in a middle section of the second frame part, a bracket-like joint attached to the sliding joint for revolving around the pivot, and stops arranged at opposite sides of the middle section of the second frame part for limiting sliding movement of the sliding joint, whereby the chair may be converted to a recliner and vice-versa upon sliding movement of the sliding joint.

4 Claims, 7 Drawing Figures

CHAIR CONVERTIBLE TO EASY CHAIR

BACKGROUND OF THE INVENTION

This useful model concerns a recliner chair which is a piece of furniture that, in two different positions, serves two purposes, namely sitting in the chair either to work or to rest in it.

SUMMARY OF THE INVENTION

The usefulness of the object is marked in light of the continuing reduction of usable space in dwellings and a partments. The increasing availability of places with less space, for the use of furniture as well as its storage, has led to the appearance of multipurpose furniture such as easy chairs or sofa beds and now, this recliner chair of a new type.

In addition to the achievement of two different purposes with the same item of furniture, its utility is increased in that it is easily disassembled, thus permitting its storage in limited space.

In addition, its cost is the same as it would be if only one function were met so that each purpose is served at half the price of this piece of furniture.

To shift from one to the other function described, only simple and easy motions are required, thus providing a further incentive for using this invention.

The piece of furniture consists of two pieces, joints, reinforcements and stops. One of the pieces is made up of a structure that includes the seat of the chair and two of the legs of the combined unit, while the second piece consists of the back of the chair and recliner as well as the seat of the recliner, the structure of which makes up the second supporting pair of legs when the piece of furniture is used as a chair.

Lastly, it is useful to point out that any kind of covering can be used for the unit that has been described, and that the tubular section can be replaced by any ordinary polygonal section.

The characteristics of the recliner or easy chair, with reference to the attached figures, show one way of building it without being limited to this form, which is presented by way of illustration of the model for the indicated purpose since the dimensions, colors and fabrics with which the different pieces are made will, in each case, be those considered most appropriate for the specific use involved without these variations. Other changes can be made in details of appearance or structure, affecting the essence of what is claimed so that recliner chairs that may be produced in accordance with the general idea that is outlined, and any of those modifications will only be variations, equally included and protected.

DETAILED DESCRIPTION OF THE PREFERRED EMBODIMENTS

With reference to these figures and to the numbers on them that indicate the different parts and details of the recliner chair that is depicted, and that are of interest for the purposes of this account, the description is as follows: The whole structure is made up of independent first frame part 1 and second frame part 3 (FIG. 1) that are linked together by joint 2 which will be described in full detail later on.

Figure 1:
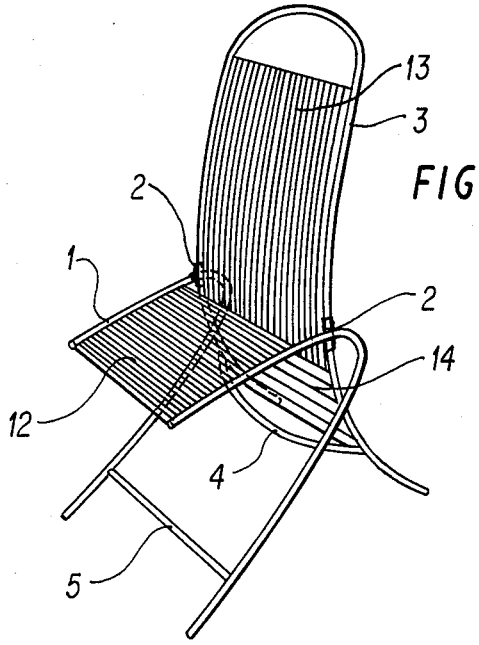
FIG. 1 is a view of the whole unit used as a chair.

In FIG. 1, those two parts are shown in such fashion that they form a chair, its back (13) resting on second frame part 3 and forming the seat (12) within the upper structure of first frame part 1.

In this figure, the braces are also shown—back brace (4) of second frame part 3 and leg brace (5) of first frame part 1—the basic purpose of which is to help to maintain the shape of the pieces by making the unit rigid.

Figure 2:
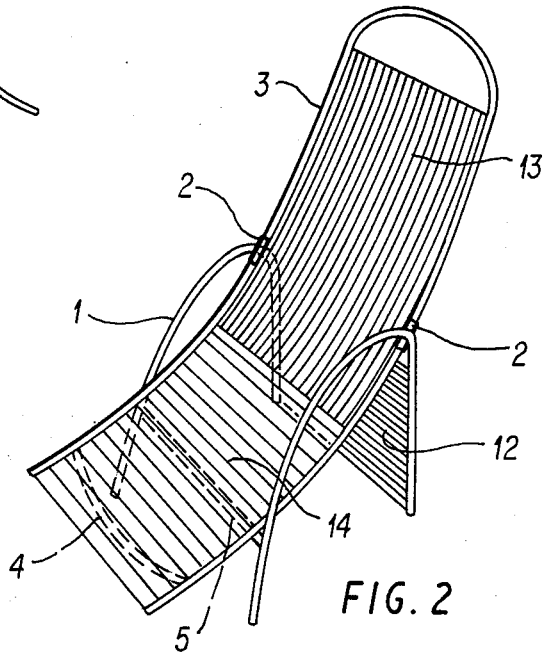
FIG. 2 is another view of the whole unit when it is used as a recliner.

In FIG. 2, another position of the same chair is shown, and the elements previously described in a different recliner position are seen.

In this figure, it is apparent that the seat (12) serves to support the recliner, and the back (13) is extended by the canework (14) to form the actual seat of the recliner.

Figure 3:
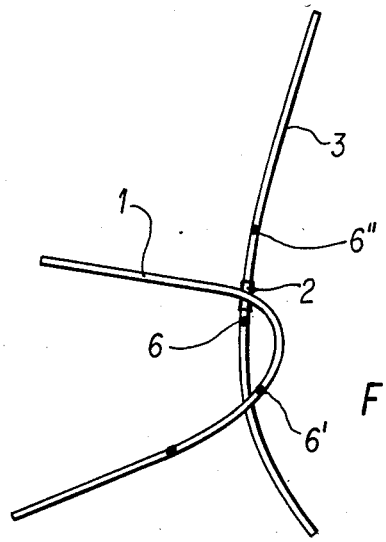
FIG. 3 is a view of a raised cross section of the chair.
Figure 4:
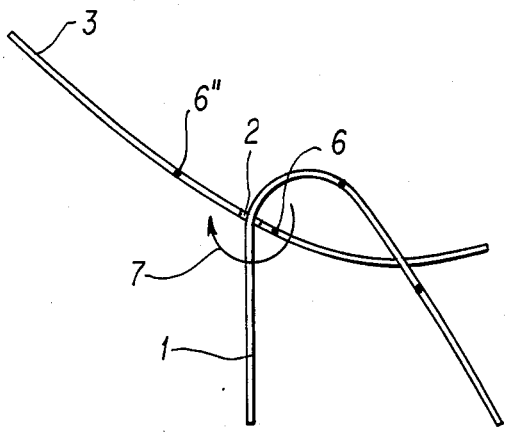
FIG. 4 is similarly a view of a raised cross section of the recliner revolving.
Figure 6:
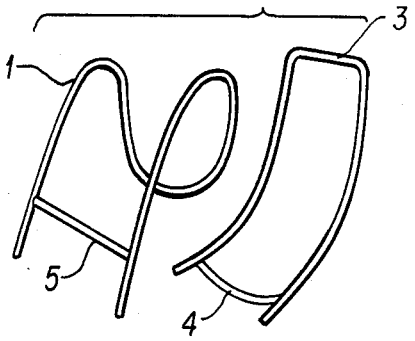
FIG. 6 shows a view of the two basic pieces of the structure on which two varied forms, one rounded and the other rectangular, have been placed. And finally.
Figure 5:
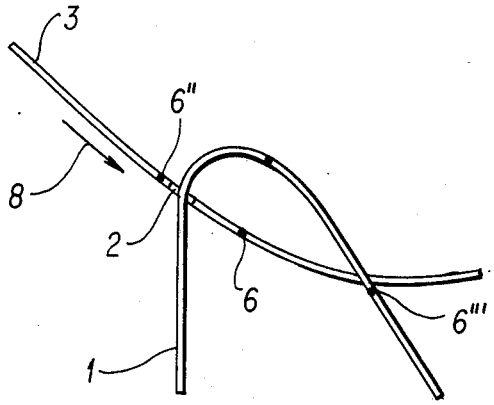
FIG. 5 shows a view of a raised cross section of the recliner in its final position.

In addition to these parts that have been described, it is necessary to point out the existence of the stops (6), the location of which is shown in FIGS. 3, 4, and 5, and the purpose of which is to limit the movement of the various parts to certain positions. In FIG. 3, for example, one sees how stop 6' specifically prevents movement of the two frame parts 1 and 3, once they are set up as a chair. Similarly, FIG. 4 shows an intermediate position of the frame parts 1 and 3 revolving in the direction indicated by the curved arrow (7) to form a recliner which only occurs when the position shown in FIG. 5 is reached in which the second frame part 3 rests on stop 6'' following the direction indicated by the arrow (8), as well as on stop 6''' as the second frame part 3 revolves around its joint (2). In FIG. 6 the two frame parts 1 and 3 are shown separately, one of them with its end rounded and the other straight. It is necessary to point out that both can be straight or rounded or either of them can have a curved or straight end according to the decorative effect that is sought.

Figure 7:
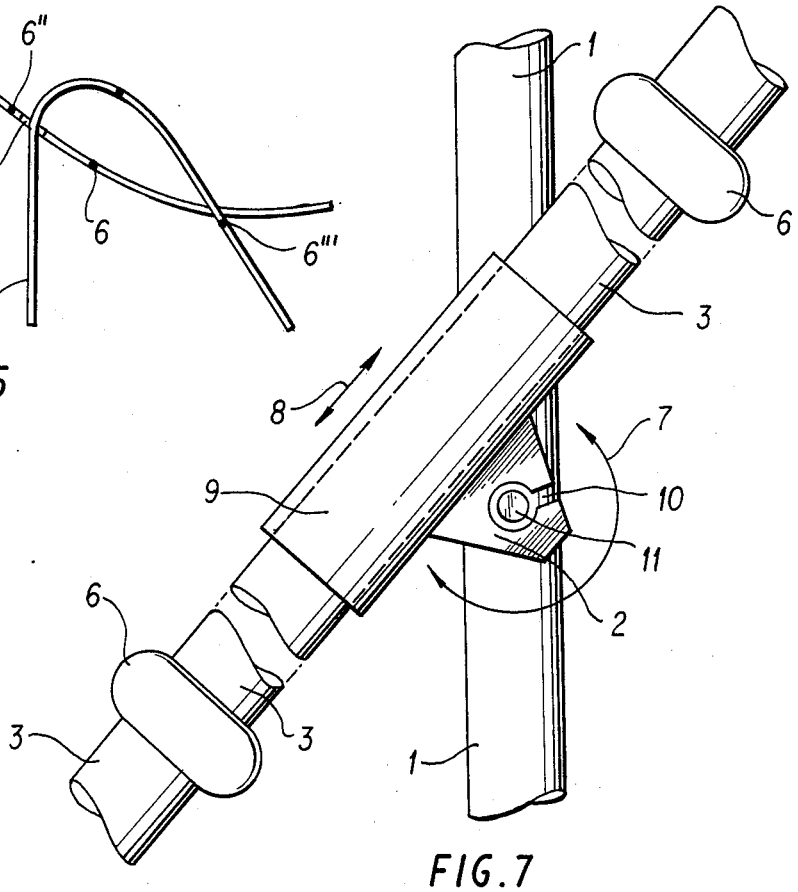
FIG. 7 shows the joint mechanism.

Lastly, FIG. 7 shows the joint 2 that serves to connect frame parts 1 and 3 respectively. In this figure one can see specifically how the second frame part 3 has a sliding joint (9), the movement of which is limited by two stops (6) and (6'') that rest on the joint (9), in accordance with the position in which the piece of furniture is used.

In this FIG. 7, the direction of the turn (7) is counterclockwise. The movement (8) of one piece in relation to the other is shown, as well as the connection of the joint (9) to the bracket-like joint 2 itself. Joint 2 consists of flexible material and is equipped with a slot (10), the purpose of which is to facilitate the assembly and disassembly of these two frame parts 1 and 3. This bracket-like joint 2 is mounted over the revolving pivot (11) attached to the first frame part 1, thus completing the connection. This useful model is based on the following claims.

I claim:

1. A chair convertible to a recliner comprising:

a first frame part having a shape in an outline that forms two parallel curved lines that are connected to each other at one end by one of a curved and a straight line;

a pivot arranged in a middle section on the first frame part;

a second frame part having a shape and lines different than the shape and lines of the first frame;

a sliding joint slidably mounted on the second frame part and connected to a bracket-like joint means;

said bracket-like joint means pivotably attached to the first frame part at the pivot for revolving around the pivot;

first and second stop means on the second frame part and arranged at opposite sides of the sliding joint, for limiting sliding movement of the sliding joint;

third and fourth stop means at spaced locations on the first frame part;

whereby, upon sliding movement of the sliding joint and selective engagement of portions of the second frame with respective ones of the third and fourth stop means, the chair may be converted to a recliner and vice-versa.

2. The chair according to claim 1, wherein:

said bracket-like joint means is made of flexible material and has a slot that permits entry and exit of the pivot so that the bracket-like joint means may revolve therearound.

3. The chair, according to claim 1, further comprising:

a first covering means, extended between the lines of the first frame part, for providing support for a user sitting thereupon; and a second covering means, made of cloth or the like and extended between the lines of the second frame part, for providing support for a user sitting thereupon.

4. The chair, according to claim 1, further comprising:

a crosspiece means, connected between the two parallel curved lines near the other end of the first frame part, for keeping the two curved lines parallel.

* * * * *